US008288946B2

(12) United States Patent
Matsushima et al.

(10) Patent No.: US 8,288,946 B2
(45) Date of Patent: Oct. 16, 2012

(54) DISCHARGE LAMP WITH A PRESSURE-RESISTANT HYDROGEN GETTER

(75) Inventors: Takeo Matsushima, Gotenba (JP); Yukio Yasuda, Gotenba (JP); Yutaka Mune, Gotenba (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 148 days.

(21) Appl. No.: 12/553,504

(22) Filed: Sep. 3, 2009

(65) Prior Publication Data

US 2010/0060159 A1 Mar. 11, 2010

(30) Foreign Application Priority Data

Sep. 10, 2008 (JP) ..... 2008-231870

(51) Int. Cl.
*H01J 61/26* (2006.01)

(52) U.S. Cl. ..... 313/561; 313/623; 313/627; 445/22; 445/26; 445/27

(58) Field of Classification Search ..... 313/561, 313/627–643, 567, 25, 26.3, 318.01–318.12; 439/226; 445/22, 26–27
See application file for complete search history.

(56) References Cited

U.S. PATENT DOCUMENTS

| | | | | |
|---|---|---|---|---|
| 3,953,755 | A | 4/1976 | Kuus et al. | |
| 4,127,790 | A * | 11/1978 | Kuus et al. | 313/562 |
| 4,717,852 | A * | 1/1988 | Dobrusskin et al. | 313/25 |
| 5,712,530 | A | 1/1998 | Inoue et al. | |
| 6,369,508 | B1 * | 4/2002 | Lochschmidt | 313/558 |
| 2005/0017644 | A1 * | 1/2005 | Ono et al. | 313/633 |

FOREIGN PATENT DOCUMENTS

| | | | |
|---|---|---|---|
| AT | 196027 | B | 2/1958 |
| JP | 52-103879 | A | 8/1977 |
| JP | 57-21835 | B2 | 5/1982 |
| JP | 53-94468 | A | 8/1999 |

* cited by examiner

*Primary Examiner* — Tracie Y Green
(74) *Attorney, Agent, or Firm* — Roberts Mlotkowski Safran & Cole, P.C.; David S. Safran

(57) ABSTRACT

To provide a flickerless discharge lamp which can remove hydrogen by a simple and safe means even if the lamp is a large discharge lamp with high pressure when lit, the discharge lamp has a pair of electrodes and a hydrogen getter (4) in the interior of an arc tube, the hydrogen getter (4) being formed of a container (41) made of metal which is hydrogen permeable and a hydrogen absorbent body (42) that is composed of a metal which can absorb hydrogen that is enclosed inside of the container (41) and is fixed to an inside wall of the container (41).

9 Claims, 10 Drawing Sheets

Fig. 9

| Space Length | Pressure Resistance Value |
|---|---|
| *d* / mm | MPa |
| 40 | 1.5 |
| 30 | 1.6 |
| 20 | 1.7 |
| 15 | 1.8 |
| 10 | 2.1 |
| 8 | 2.2 |
| 6 | 2.3 |
| 4 | 2.7 |
| 2 | 3.3 |
| 0 | > 10 |

DISCHARGE LAMP WITH A PRESSURE-RESISTANT HYDROGEN GETTER

BACKGROUND OF THE INVENTION

The present invention relates to a discharge lamp, and more particularly, to a discharge lamp which is used as a light source for exposing semiconductor wafers, liquid crystal glass substrates, printed circuit boards, color filters or the like; or is used as a light source for image projection when projecting images onto screens in movie theaters, or the like.

DESCRIPTION OF RELATED ART

Short arc type mercury discharge lamps were conventionally used as ultraviolet light sources in a variety of exposure processes such as for semiconductors, liquid crystals, or printed circuit boards. Recently, larger exposure areas and higher throughput have been realized in exposure processes for liquid crystal substrates or color filters.

Short arc type xenon lamps have also been used as light sources for visible light in film projectors, or the like.

FIG. 10 is a schematic depiction of the configuration of a conventional discharge lamp charged with mercury.

An arc tube 10 of a discharge lamp 1, composed from quartz glass, comprises a roughly spherical shaped light emitting part 11, inside of which a space S is formed, and side tube parts 12 formed on opposite sides of the light emitting part 11. The light emitting part 11 contains a pair of electrodes 13A, 13C disposed opposite each other, and the space S is filled with a discharge gas. Electrode rods 14, which support the electrodes 13A, 13C, respectively, are electrically connected to external leads (not shown) which project outward from the side tube parts 12, and supply electric power from an external source.

Getter metal 15, such as tantalum wire, is directly fixed to the periphery of the electrode rod 14 which supports the electrode 13C in the space S. The material for the getter metal 15 is tantalum which can also absorb and bind oxygen, carbon dioxide, or other impurities (Japanese Patent Publication No. 3077538, corresponding to U.S. Pat. No. 5,712,530 A).

Yttrium with a large of amount of hydrogen absorption is previously known as a getter metal used in hydrogen getters to remove hydrogen (Japanese Patent Publication 57-21835, corresponding to U.S. Pat. No. 3,953,755 A).

In the above-mentioned patent document, a high-pressure gas discharge lamp is disclosed wherein a hydrogen getter having yttrium or other hydrogen getter material therein is covered by a metal outer casing made of tantalum or other hydrogen permeable metal, and is provided inside a discharge vessel.

FIG. 11 is a cross-sectional view of a hydrogen getter in a discharge lamp according to the above-mentioned patent publication. A hydrogen getter 5 is a getter composite body constituted from a metal outer casing comprised of a bottomed cylinder 51 made from tantalum or other metal and a cover 53, and a hydrogen absorbent body 52 composed from cylindrical yttrium enclosed therein. In the case of a hydrogen getter in the above-mentioned discharge lamp, the interior of the metal outer casing is sealed by welding together the flange parts 512 of the bottomed cylinder 51 and the cover 53; the hydrogen in the light emission space enters through the metal outer casing having tantalum or other hydrogen permeable metal; and the hydrogen is absorbed in the hydrogen absorbent body 52. Because the yttrium enclosed therein is covered by the metal outer casing, the yttrium can absorb hydrogen without reacting with other substances in the light emission space.

Recently, as lamps became larger, a problem in which temporal illuminance variation on the exposure face increased became prominent. By thoroughly studying the problem, the inventors found that the problem is related to the hydrogen concentration in the space. The degree to which hydrogen is emitted into the light emission space is posited as follows.

The arc tubes of these discharge lamps are formed by heating quartz glass using an oxyhydrogen burner. During the heating process, the water or hydrogen present in the quartz glass dissolves. Because the temperature of the arc tube reaches a high temperature of 500° C. or more while the lamp is lit, the dissolved hydrogen or water is released into the arc tube as impurity gas. Namely, when the lamp is made larger, the amount of water or hydrogen which is released from the arc tube increases. With a conventional tantalum getter, however, it is possible that the amount of hydrogen absorption was insufficient compared to the amount of hydrogen that should have been removed.

For example, because the amount of hydrogen absorbed by tantalum is minimal, even if the amount of getter metal was increased to achieve sufficient hydrogen absorption, the weight thereof would be massive and installation thereof inside the lamp would not be possible.

Yttrium, on the other hand, has a high degree of hydrogen absorption. Because yttrium reacts with mercury, however, a metal outer casing or other protective means like the ones set forth in Japanese Patent Publication 57-21835 and corresponding U.S. Pat. No. 3,953,755 A is necessary. Additionally, because the weight of hydrogen must be increased to some extent as the amount of the released hydrogen is increased, the metal outer casing which covers the yttrium also becomes larger.

When the metal outer casing is made larger and the surface area thereof increases, the pressure exerted onto the metal container also increases. Also, this problem becomes prominent in lamps which have high internal pressure when lit. Furthermore, making the metal outer casing thicker than a given thickness in order to maintain the hydrogen permeation rate is not possible because hydrogen getters must absorb hydrogen rapidly. As a result, there was a problem in which the metal outer casing could not withstand the pressure and was damaged.

SUMMARY OF THE INVENTION

Thus, an object of the present invention is to provide a flickerless discharge lamp which can remove hydrogen by a simple and safe means even if the lamp is a large discharge lamp with high pressure when lit.

The present invention is characterized in that, in a discharge lamp comprising a pair of electrodes and a hydrogen getter in the arc tube interior, the hydrogen getter comprises a container composed from metal which is hydrogen permeable and a hydrogen absorbent body which can absorb hydrogen that is enclosed inside the container; and the hydrogen absorbent body is melted and fixed to the inside wall of the container.

The present invention is also characterized in that the container is a tubular member having an enclosed part on at least one end, and the hydrogen absorbent body is melted and fixed to the inside wall near the enclosed part.

Furthermore, in accordance with the present invention, the container is composed of tantalum, molybdenum, or niobium, or a metal comprising one of the above metals.

Another feature of the present invention is that the hydrogen absorbent body is composed of yttrium, zirconium, or a metal comprising one of the above metals.

Due to the above, hydrogen can be introduced and absorbed without allowing mercury to enter into the container. It is also possible for the hydrogen absorbent body which is melted and fixed to the inside wall of the container to reinforce the sealed portion of the container and increase the pressure resistance thereof. Thus, even if high pressure is applied thereto, there is no worry of damage, a large amount of hydrogen can be absorbed, and lamp flicker can be reduced.

According to the present invention, because the container is a tubular member having a sealed part on at least one end, and the hydrogen absorbent body is melted and fixed to the inside wall near the sealed part, through a simple manufacturing method, a hydrogen getter which has excellent durability and is convenient to install can be introduced inside the light emission part of the lamp, and can reduce flickering of the discharge lamp caused by hydrogen.

According to the present invention, because the container is composed from tantalum, molybdenum, or niobium, or a metal comprising one of the above metals, hydrogen can be satisfactorily transmitted and introduced inside the container without the container melting when at high temperature inside the arc tube while the lamp is lit.

Also, hydrogen can be transmitted and introduced inside the container without reacting with the mercury in a lamp which is filled with mercury.

According to the present invention, because the hydrogen absorbent body is composed from yttrium, zirconium, or a metal comprising one of the above metals, sufficient hydrogen absorption capacity can be exerted to absorb hydrogen.

These and other features and advantages of the invention will become apparent from the following detailed description in combination with the accompanying drawings.

BRIEF DESCRIPTION OF THE DRAWINGS

FIG. 5(*b*) shows a hydrogen getter installed on an electrode;

FIG. 9 is a table showing experimental results relating to a discharge lamp according to the present invention;

DETAILED DESCRIPTION OF THE INVENTION

Figure 1:
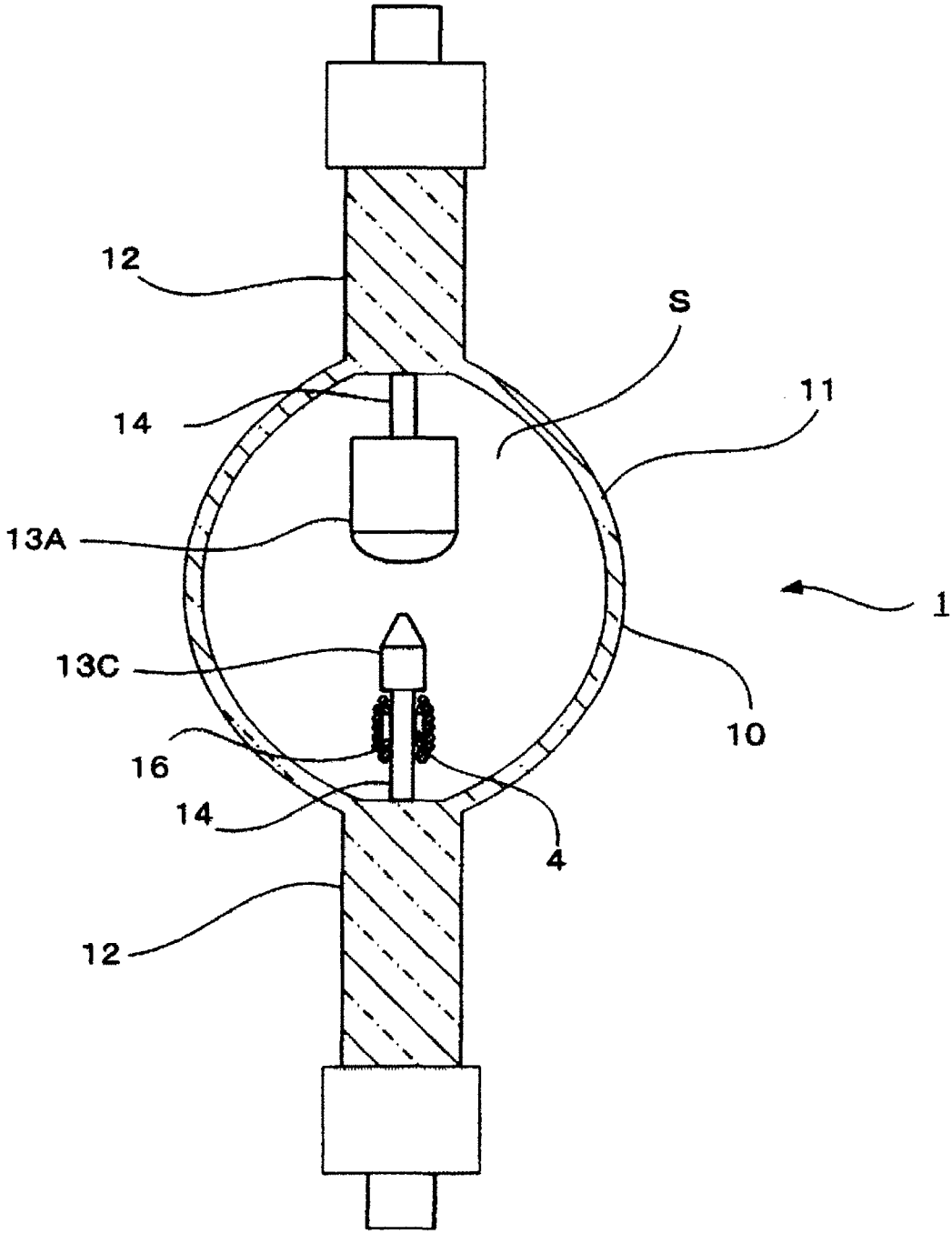
FIG. 1 is a schematic depiction of a discharge lamp according to a first embodiment of the present invention.

FIG. 1 shows a discharge lamp in accordance with a first embodiment of the present invention having an arc tube 10 made of quartz glass and having a roughly spherical shaped light emitting part 11 enclosing a discharge space S, and roughly column-shaped side tube parts 12 formed on opposite sides of the light emitting part 11. Opposed electrodes are disposed in the light emitting part 11 and comprise a cathode with an electrode body portion 13C and an anode with an electrode body portion 13A. Additionally, mercury and a rare gas, such as, argon, krypton, or xenon, are filled in the space S inside of the light emitting part 11.

The amount of mercury charged in the space is within the range from 1 mg/cm$^3$ to 65 mg/cm$^3$ per inside volume of the space. For example, 35 mg/cm$^3$ is provided. The amount of rare gas charged is within the range from $2.5\times10^4$ Pa to $5\times10^5$ Pa. For example, $8\times10^4$ Pa is provided.

The cathode body portion 13C and the anode body portion 13A are composed of tungsten, for example, and each pole is supported by an electrode rod 14. A hydrogen getter 4 is disposed on the periphery of the electrode rods 14.

The electrode rod 14 projects from the side tube part 12 along the tube axis, and is located almost coaxially with the electrode rod 14 on the other electrode side. The base end side (the side opposite the distal end) of the electrode rod 14 is electrically connected to and supplies power to the electrically conductive component (not shown) in the side tube part 12, and the lead pin projecting to the outside.

The cathode body portion 13C has a roughly cylindrical shape with a diameter more than that of the electrode rod 14, and the distal end (tip) thereof constitutes a roughly truncated cone. The cathode body portion 13C can be supported by connecting an electrode rod 14, or the cathode body portion 13C and the electrode rod 14 can be integrally formed by a single member.

The anode body portion 13A has a roughly cylindrical shape with a diameter more than that of the electrode rod 14, and the distal end (tip) thereof constitutes a roughly truncated cone or essentially has the shape of a canon ball. Similar to the case of the cathode, the anode body portion 13A can be supported by connecting an electrode rod 14, or the anode body portion 13A and the electrode rod 14 can be integrally formed by a single member.

A plurality of straight cylindrical hydrogen getters 4 are disposed so as to be arranged on the outer circumference of the electrode rod 14 in the circumferential direction, and wire 16 is wound and fixed onto the electrode rod 14. As regards the installation of the hydrogen getters 4 inside the light emitting part, the method of installing the hydrogen getters 4 is not limited to this method.

Figure 2A:
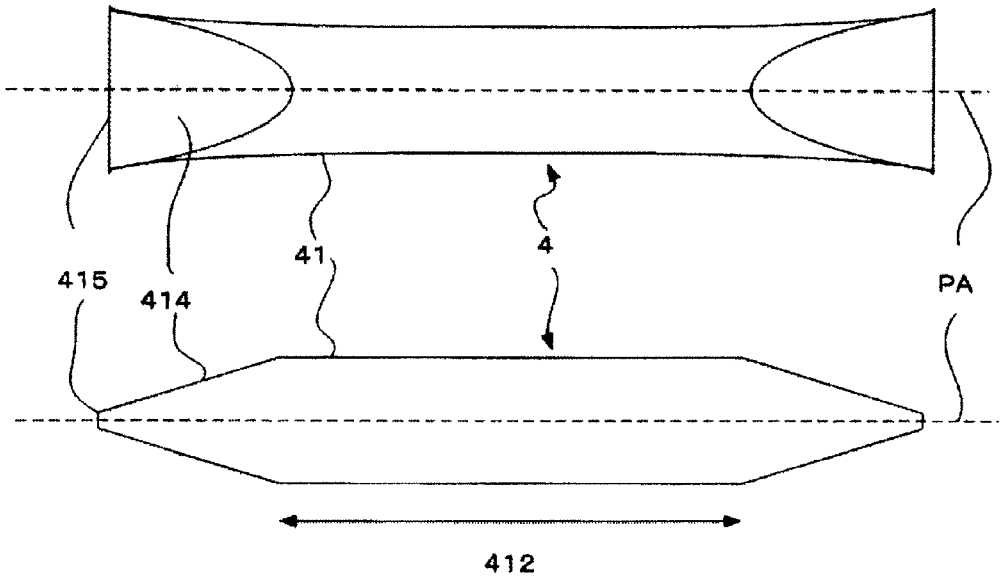
FIG. 2(*a*) is a schematic depiction of a hydrogen getter according to the present invention from above and one side; and 2(*b*) is a vertical cross-sectional view of the hydrogen getter taken along axis PA.
Figure 2B:
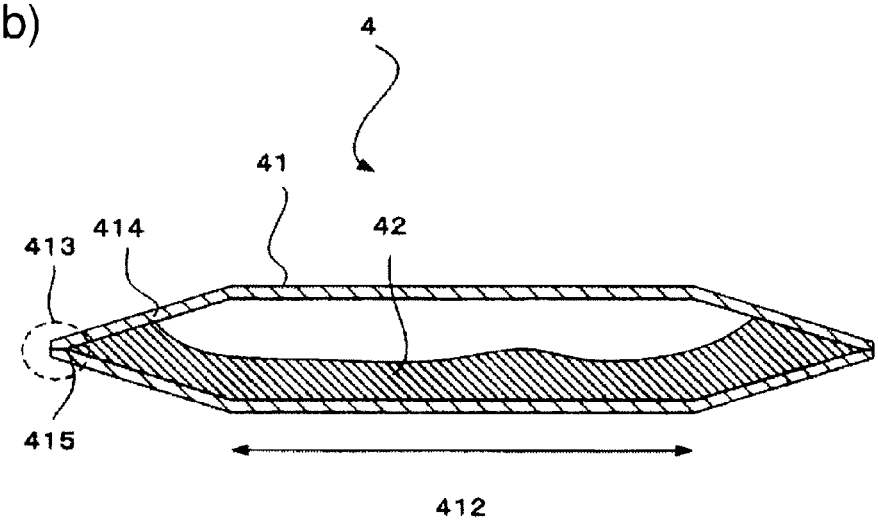

As shown in FIG. 2(*a*), the hydrogen getter 4 comprises a cylindrical container 41 formed of a highly hydrogen permeable metal, and both ends of the container 41 are sealed airtight. An example of dimensions for the cylindrical container 41 are an internal diameter of 3 mm, a thickness of 0.1 mm, and a length of 30 mm. Preferred materials for the container 41 are tantalum, molybdenum, niobium, or any metal containing either one of these metals which have excellent hydrogen permeability.

A hydrogen absorbent body 42 is enclosed inside the container 41. Using yttrium or zirconium, which have high hydrogen absorption capacity, in the hydrogen absorbent body 42 is preferred. A metal which contains yttrium or zirconium is also acceptable. Either establishing a vacuum ($10^{-1}$ Pa or less for example) to prevent oxidation of the hydrogen absorbent body 42, or charging a rare gas in the remaining internal space is preferred.

Thus, the hydrogen absorbent body 42 is arranged so the internal space of the container 41 is isolated from the exterior and the hydrogen absorbent body 42 does not react with the mercury inside the arc tube 10.

On the other hand, the tantalum, molybdenum, or niobium of which the container 41 may be formed are metals which will not react with the mercury in the arc tube 10 even when in contact with the mercury, and hydrogen permeable. Consequently, this container 41 will allow hydrogen to enter into the interior thereof without allowing mercury to enter the interior thereof.

In a sealed portion 413 of the container 41 in FIG. 2(*b*), both end parts of the tube are pressed from above and below and folded together, and the sealed portion 413 is closed by pressure welding. The end parts of the completed container form a flat part 414 which is inclined relative to the container 41.

When a flat shape like the sealed portion 413 exists in the container 41 and the interior thereof is hollow and no hydrogen absorbent body is fixed therein, pressure is applied to the outer surface of the container 41 inside the arc tube from all directions when the lamp is lit, there are cases in which the container 41 is transformed because the shape thereof is not uniform, and the hermetic seal is broken by force which pushes open the seal of the sealed portion 413.

Thus, the hydrogen absorbent body 42 is melted and fixed onto the inner wall near the sealed portion 413, and the sealed portion 413, which is the part of the container 41 that is most structurally susceptible to pressure, is thereby reinforced from the inside. In this manner, even if there is pressure from outside the container or the container is transformed by the accompanying pressure, it will not be damaged.

The center part in the tube axis direction of the container 41 is a cylindrical barrel part 412. By melting and fixing the hydrogen absorbent body 412 on the inner surface in the barrel part 412 as with the sealed portion, pressure resistance is improved because the container 41 is essentially made thicker. Thus, the pressure resistance of the container 41 can be increased while maintaining the hydrogen permeation rate into the container and having a thinner wall in the container 41.

Figure 3A:
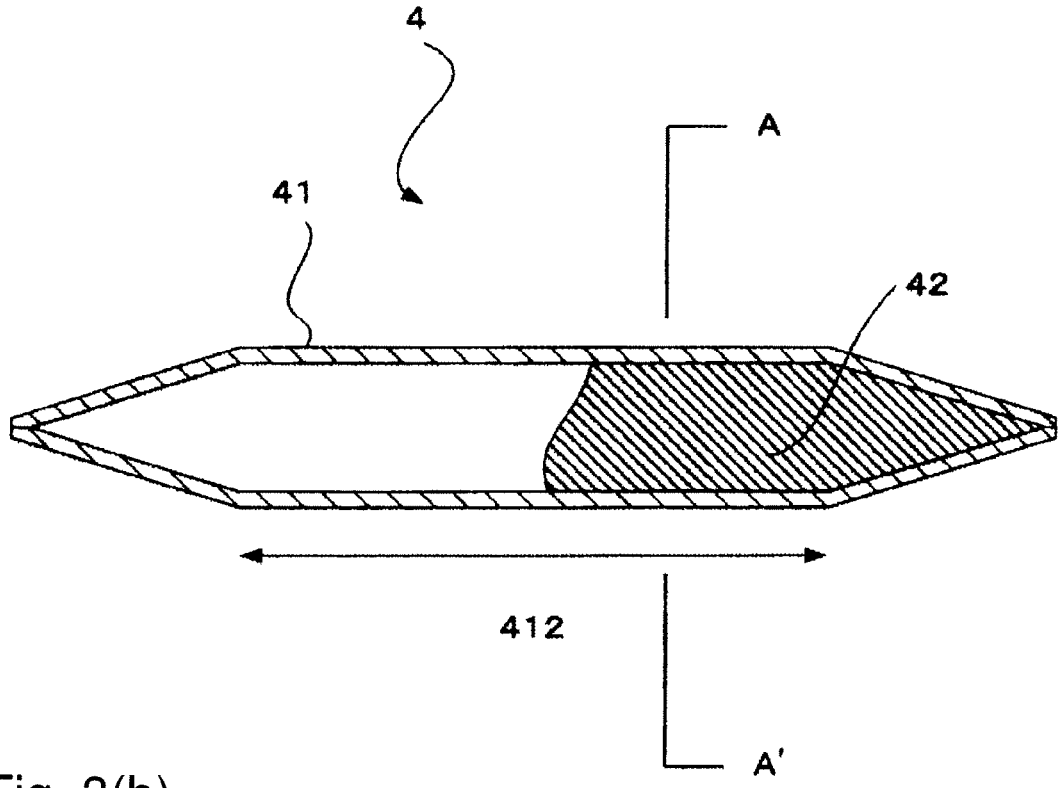
FIG. 3(*a*) is a schematic cross-sectional view of a hydrogen getter of the present invention showing the hydrogen absorbent body fixed inside the container; and 3(*b*) is a cross-sectional view taken along line A-A' in FIG. 3(*a*)
Figure 3B:
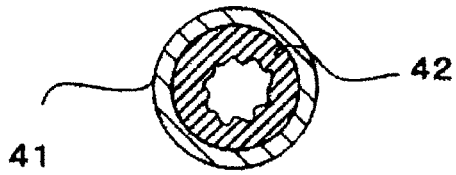

FIG. 3(*a*) is a cross-sectional view along the tube axis showing the hydrogen absorbent body melted and fixed to the inner wall of the barrel part inside of the container 41. FIG. 3(*b*) is a cross-sectional view taken along line A-A' in FIG. 3(*a*).

As shown in FIG. 3(*b*), the fixed hydrogen absorbent body 42 can reduce the pressure applied to other areas of the container 41 while filling a role similar to a backbone and improving the pressure resistance in a continuous direction without essentially increasing the thickness of the container 41, the hydrogen absorbent body 42 being melted and fixed in a continuous circular shape along the circumference of the inner wall inside the container 41.

The hydrogen absorbent body 42 can also be melted and fixed so as to cover nearly the entire inner surface of the container 41, thereby achieving an effect like the one described above and improving the pressure resistance in all directions. Namely, by fusing and fixing the hydrogen absorbent body 42 on the inner surface of the container 41, the sealed portion 413 is reinforced by the hydrogen absorbent body 42 in contrast to when a solid body of the hydrogen body 42 is simply enclosed inside the container 41, and the pressure resistance is improved by essentially increasing the thickness of the barrel part 412.

A hydrogen getter relating to the above-mentioned constitution can guide hydrogen through the container 41 composed from a hydrogen permeable metal without allowing mercury to enter inside, hydrogen can be absorbed by the hydrogen absorbent body 42 enclosed therein, and flickering of the discharge lamp can be reduced.

Because the sealed portion 413 and the wall thickness of the container 41 is reinforced by melting and fixing the hydrogen absorbent body 42 enclosed within the container 41 to the inside wall of the container 41, the pressure resistance of the container 41 is increased. As a result, there is no worry of damage, even if a large amount of hydrogen is to be absorbed, the container 41 is placed in a high pressure environment, and the hydrogen getter has a large surface area.

Furthermore, because the wall thickness of the container 41 is reinforced by melting and fixing the hydrogen absorbent body, the wall thickness of the container can be decreased and the hydrogen permeation rate can be increased.

Thus, hydrogen inside the light emitting part can be easily removed and lamp flicker can be reduced. The same effect can be achieved with other shapes of the container 41.

Figure 4:
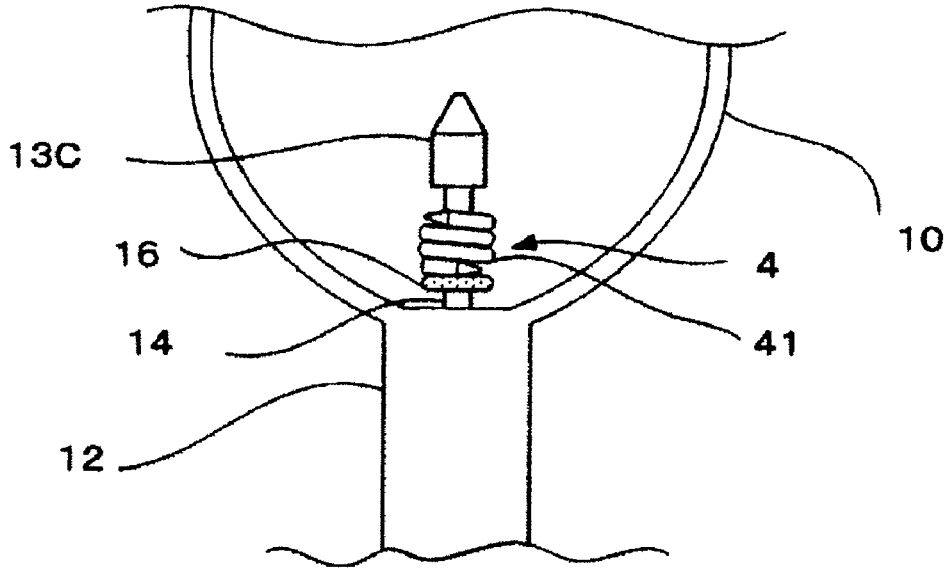
FIG. 4 is a partial sectional view of the electrode area of a lamp having a hydrogen getter in accordance with the present invention.

FIG. 4 shows an electrode and a hydrogen getter 4 similar to the one shown in FIG. 3 but in which the hydrogen getter 4 is formed by a bent-pipe shaped container 41 and is directly installed on an electrode rod 14.

In FIG. 4, the hydrogen getter 4 has a bent-pipe shape, with the container 41 being circularly wound. The basic constitution and the cross-section thereof is the same as the above-mentioned container 41 which was formed into a straight cylindrical shape. Because the container 41 of the hydrogen getter 4 shown in FIG. 4 has a length sufficient to circle around the circumference of the electrode rod 14, the container can be wrapped around and fixed thereto. Furthermore, the container can be fixed more reliably if a metal wire 16 or other auxiliary fixing member is provided.

With the above-mentioned constitution, the hydrogen getter 4, itself, comprises installation means, and can be readily installed without preparing separate installation members. Because covering the circumference thereof using wire is not necessary, the chance of hydrogen contacting increases and the hydrogen absorption capacity is increased.

Figure 5A:
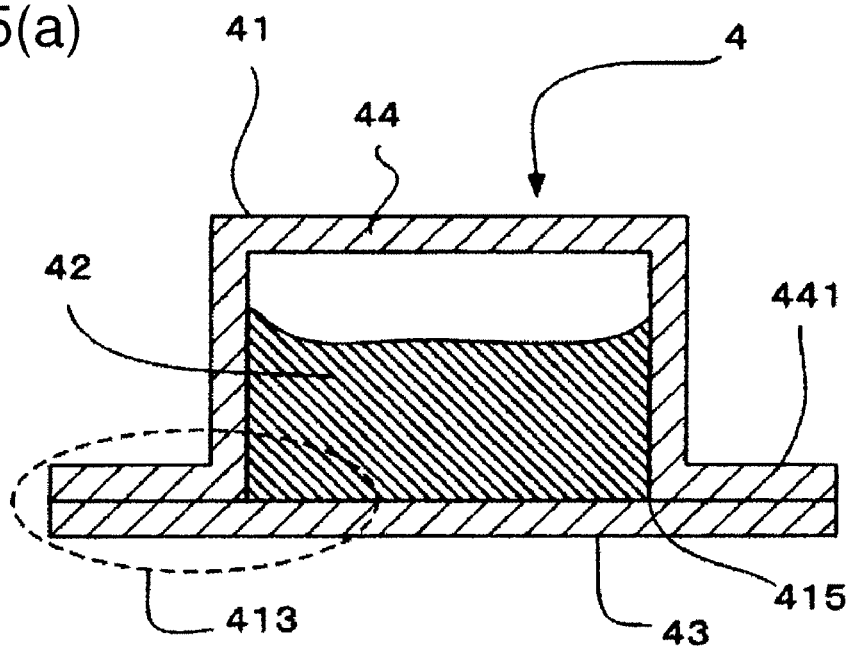
FIGS. 5(*a*) & 5(*b*) are views of an embodiment of a hydrogen getter of the present invention, in which FIG. 5(*a*) is a schematic cross-sectional view of a hydrogen getter of another embodiment.
Figure 5B:
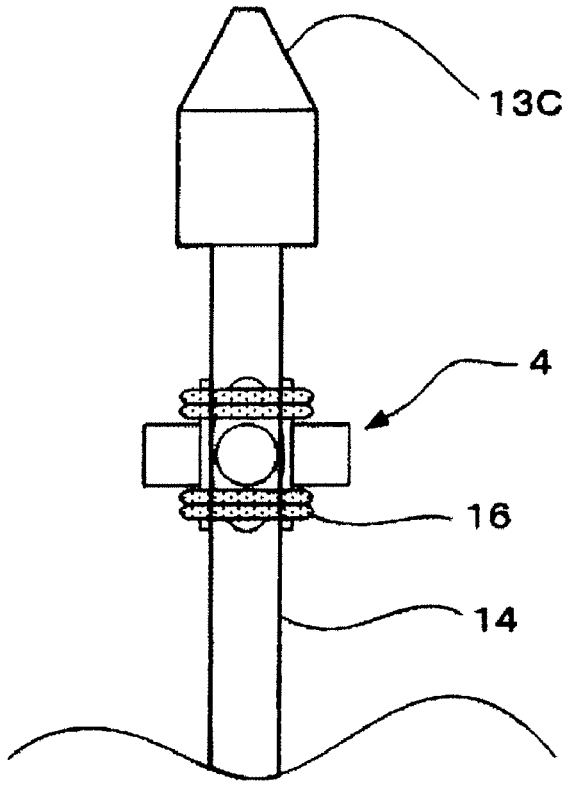

In FIG. 5(*a*), another embodiment of a hydrogen getter 4 is shown, and FIG. 5(*b*) shows a hydrogen getter 4 installed in proximity of an electrode.

In FIGS. 5(*a*) & 5(*b*), the hydrogen getter 4 comprises a tubular container 41 which is formed from a hat-shaped tube 44 and a cover 43, with a hydrogen absorbent body 42 composed from yttrium enclosed in the container 41. The hat-shaped tube 44 and the cover 43 are made of the same material as the container 41 shown in the aforementioned FIG. 2. Any other characteristics are the same as those of a hydrogen getter relating to the first embodiment.

The hat-shaped tube 44 comprises a flange part 441 wherein an opening side end part extends radially to the outside. The flange part 441 and the cover 43 are joined by pressure welding. The hydrogen absorbent body 42 enclosed therein is melted and fixed to the inner wall of the container 41 to reinforce the sealed portion 415.

As shown in FIG. 5(*b*), the hydrogen getter 4 can be fixed by binding the flange part 441 onto the circumference of the electrode rod 14 using a wire 16. Thus, the container 41 can be formed from a multi-part tube.

The hydrogen getter relating to the present invention described above can be manufactured as described below.

Figure 6A:
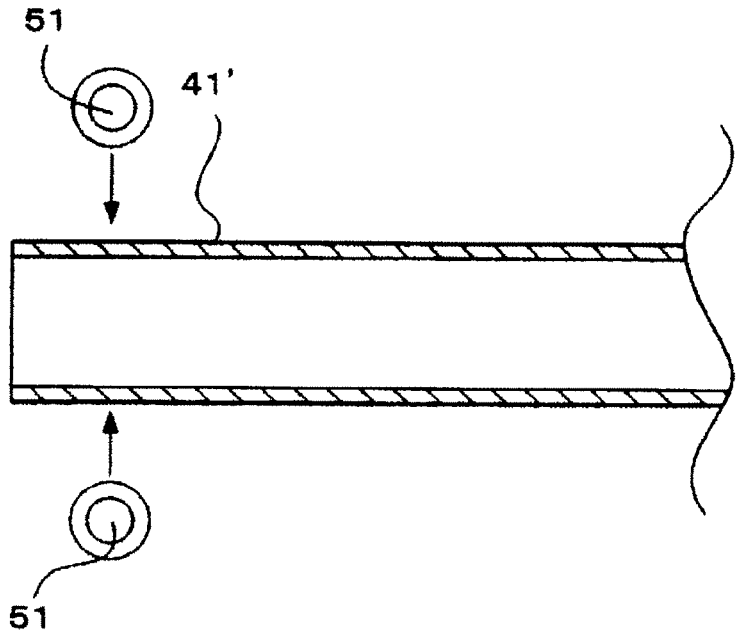
FIG. 6(*a*)-6(*c*) are cross-sectional views for explaining a method of manufacturing a hydrogen getter of the present invention.
Figure 6B:
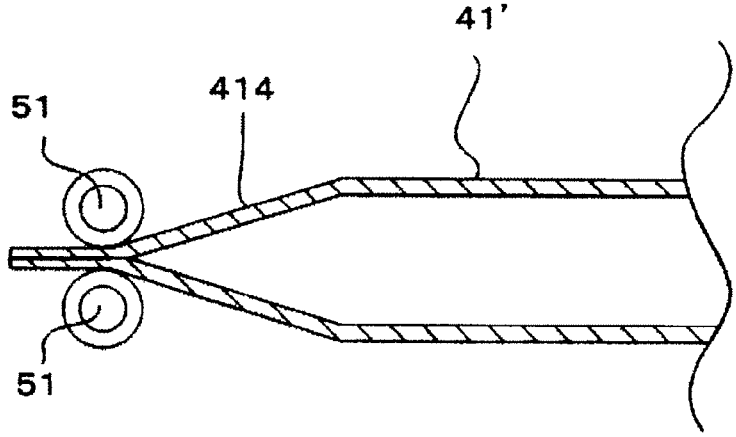
Figure 6C:
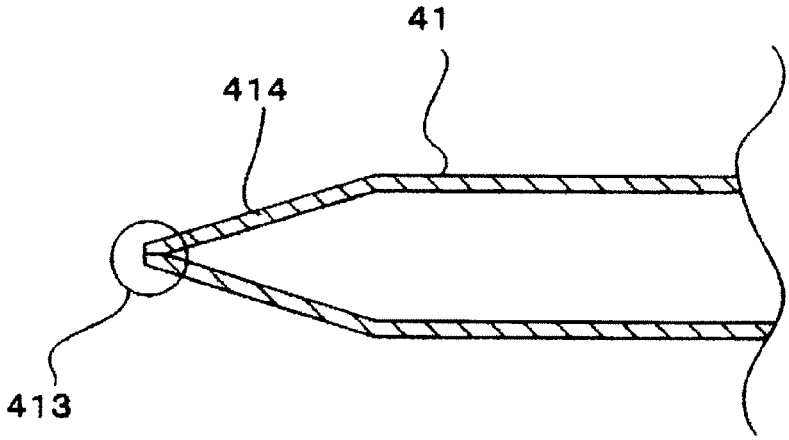

FIG. 6(*a*) shows a tube-shaped body 41' and a pair of rollers 51 for sealing one end thereof. By pressing the rollers 51 against the tube-shaped body 41' in the direction of the arrows and applying pressure, the end part of the tube-shaped body 41' is squeezed flat and is sealed by pressure welding as shown in FIG. 6(*b*). The rollers 51 are pressed together until the end part of the tube-shaped body 41' is cut. Thus, one end of the tube-shaped body 41' is sealed and cut, forming the sealed portion 413 as shown in FIG. 6(*c*).

A predetermined amount of hydrogen getter material 42' made of solid or powdered yttrium is put inside the tube-shaped body 41' that is made of tantalum, tungsten, or niobium, one end of which is joined by pressure welding. After the hydrogen getter material 42' is put inside, the other end is sealed in the same manner, and the inside of the tube-shaped body is put into a vacuum (about $10^{-1}$ Pa) or is filled with a rare gas to form the container 41.

Figure 7:
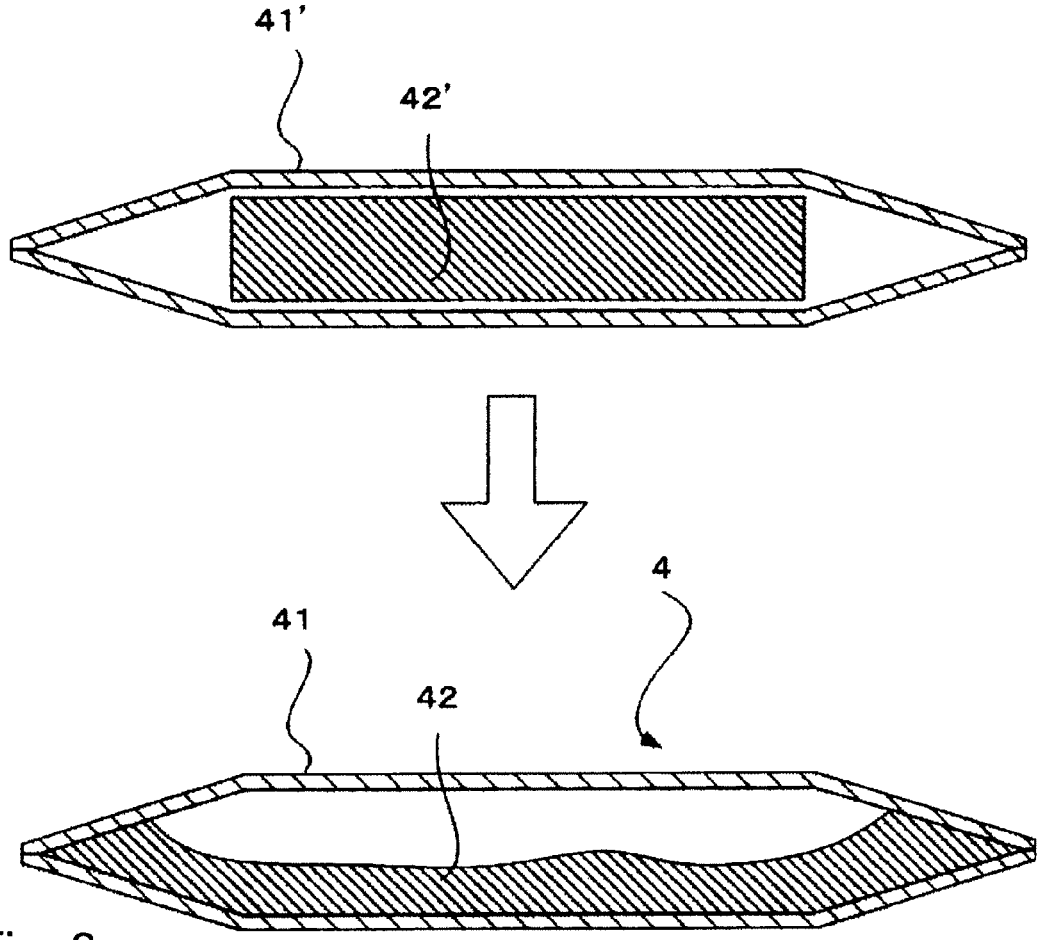
FIG. 7 is a cross-sectional view for explaining a method of manufacturing a hydrogen getter of the present invention.

FIG. 7 is a cross-sectional view which explains a method of melting and fixing the hydrogen absorbent body which is enclosed inside the container. As shown in FIG. 7, the container 41, both ends of which are sealed, maintains a vacuum. For example, yttrium which has a melting point of 1,526° C. or more is preferably kept at a temperature of 1,600° C. to 1,800° C., and the enclosed getter material 42' which has a melting point of 1,851° C. or more in the case of zirconium is preferably kept at a temperature of 1,900° C. to 2,100° C., and is then cooled. Thus, the hydrogen getter material 42' melts, and adheres to the inner surface of the container 41 to become the hydrogen absorbent body 42.

A manufacturing method such as this one makes it possible to readily manufacture a hydrogen getter in accordance with the present invention using a tube-shaped material without welding or the like using a single member.

An experimental example relating to a discharge lamp according to the present invention is described below.

Figure 8:
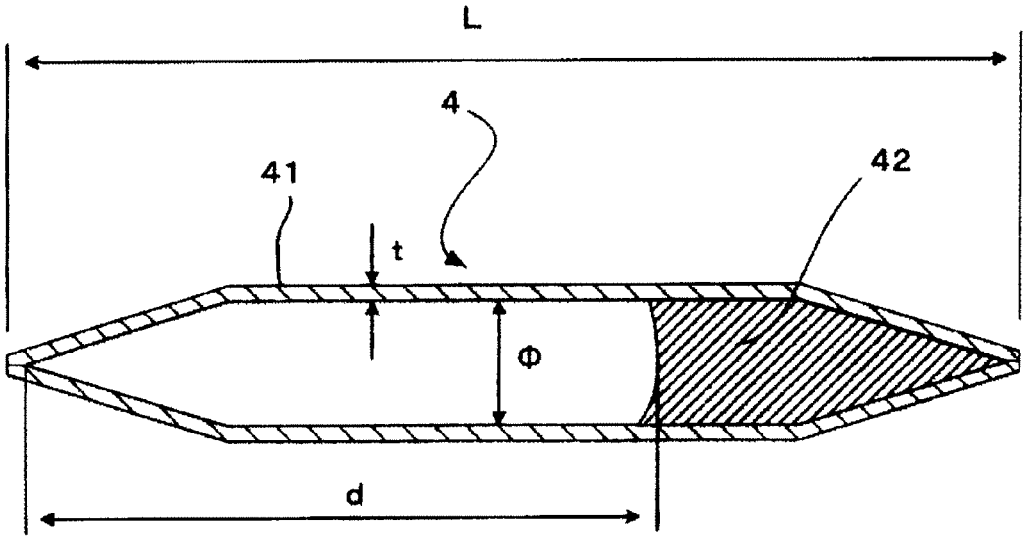
FIG. 8 is a diagram for use in describing dimensional characteristics of a hydrogen getter in accordance with the present invention.
Figure 10:
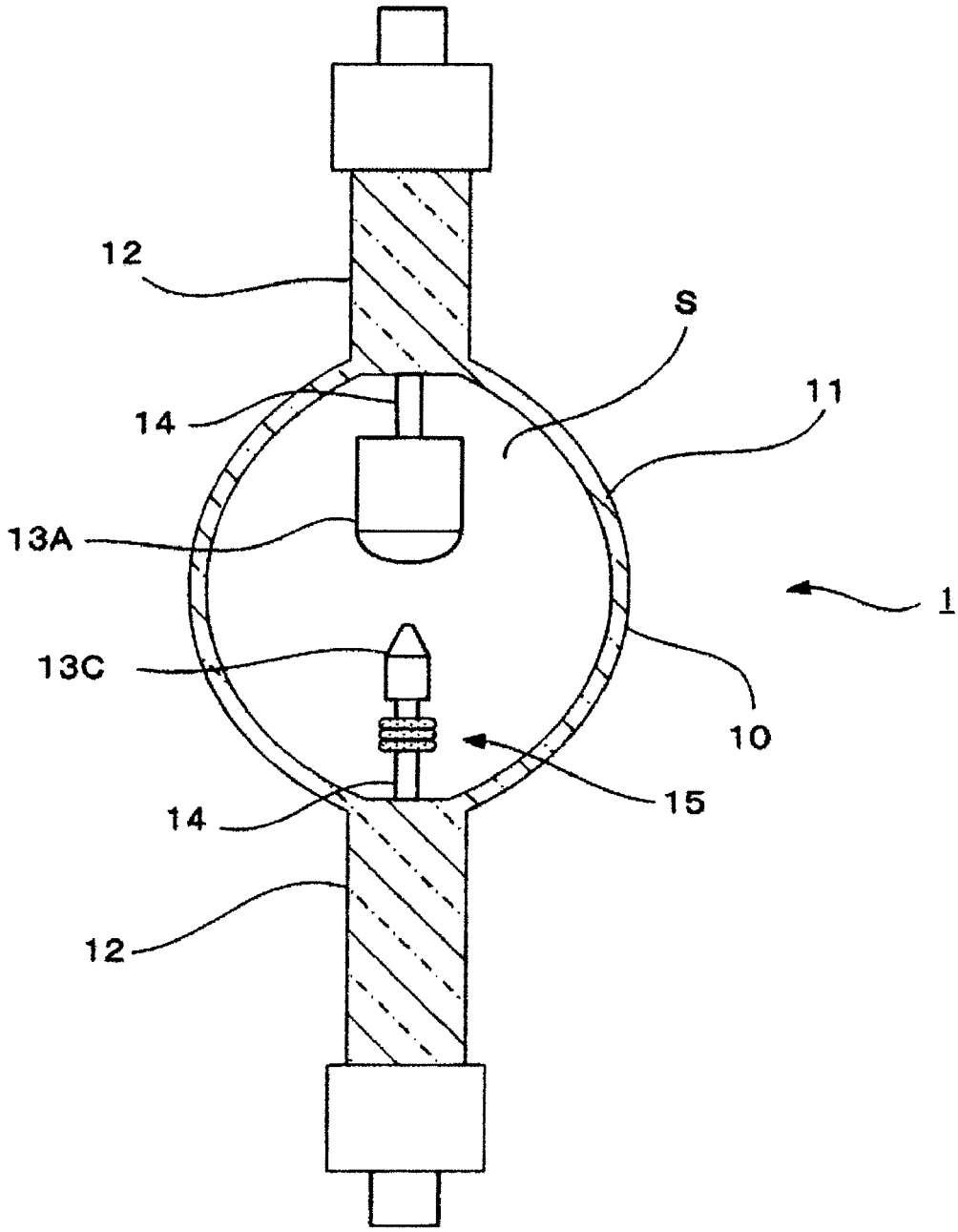
Fig. 10 (Prior Art)
FIG. 10 is a schematic depiction of a conventional discharge lamp with a getter.
Figure 11:
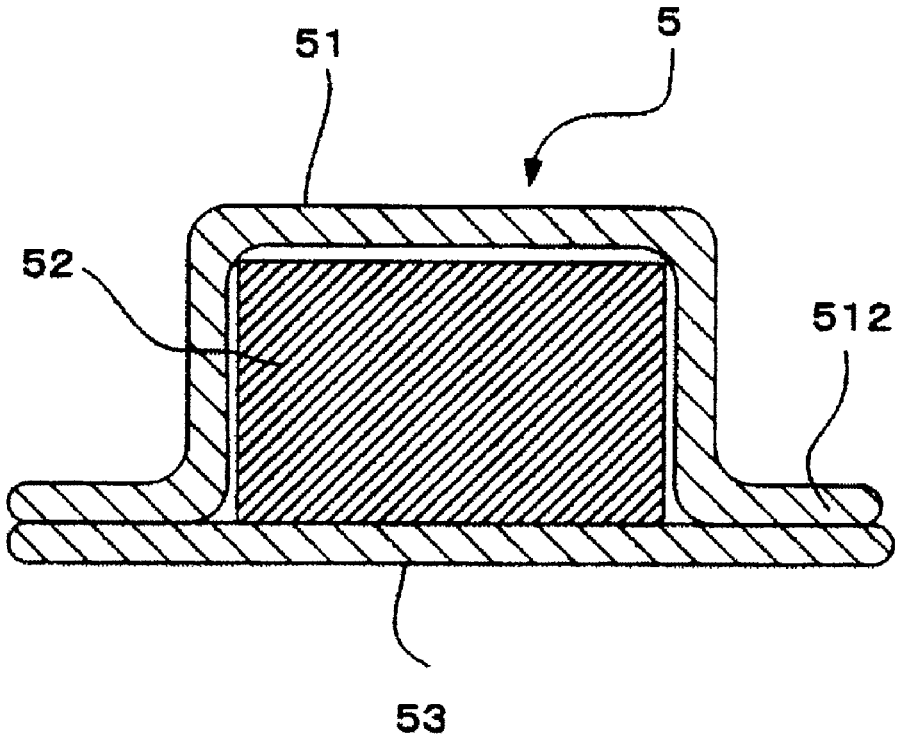
Fig. 11 (Prior Art)
FIG. 11 is schematic cross-sectional view of a conventional hydrogen getter.

FIG. 8 shows a hydrogen getter which was manufactured based on the configuration shown in FIG. 2. This hydrogen getter 4 was of a container 41 made from a tantalum tube, both ends of which were sealed, having a wall thickness t of 0.1 mm, an inner diameter $\phi$ of 3.0 mm, and a length L of 50 mm; and yttrium which was melted and fixed onto only one end part. A vacuum was established inside the container 41.

Samples were manufactured in which the space at the other end of the hydrogen getter 4 in which no hydrogen absorbent body 42 was melted and fixed has a maximum space length d along the tube axis; and the amount of yttrium was controlled to obtain various space lengths d.

Pressure resistance tests were performed on the above samples. A hydrogen getter was set inside an airtight container (not shown), ethanol was made to flow inside the airtight container and pressure was applied, and then the pressure at which the end part to which yttrium was not melted and fixed transformed was observed as the pressure resistance value.

FIG. 9 shows the relationship between the space length d (mm) and the pressure resistance value (MPa) at the end part to which yttrium was not melted and fixed. The pressure resistance value was found to rise as the space length d became shorter. Namely, the pressure resistance was found to rise as areas to which yttrium was melted and fixed increased. The end part to which yttrium was fixed (when d=0) was not transformed in any sample even when pressure exceeding 10 MPa was applied thereto.

It was therefore found that pressure resistance rose when yttrium was melted and fixed to the sealed portion. It was also found that pressure resistance rose as the space length decreased, when yttrium was melted and fixed also in the barrel part.

What is claimed is:

1. Discharge lamp comprising an arc tube made of quartz glass with a pair of electrodes and a hydrogen getter in the inside thereof, the hydrogen getter being operative for removing hydrogen produced due to heating of the quartz glass of the arc tube during operation of the lamp; said hydrogen getter comprising a container formed of a metal which is hydrogen permeable and a hydrogen absorbent body that is formed of a metal which can absorb hydrogen that is enclosed inside said container; wherein said hydrogen absorbent body is fixed by having been fused to an inside wall of said container, wherein said hydrogen permeable metal of which the container is formed is one of tantalum, molybdenum, niobium, or a metal comprising one of tantalum, molybdenum, and niobium.

2. The discharge lamp according to claim 1, wherein said container comprises a tube-shaped member having a sealed part at at least one end, and wherein said hydrogen absorbent body is fixed by being fused to the inside wall near the sealed part.

3. The discharge lamp according to claim 2, wherein said metal which can absorb hydrogen of which the hydrogen absorbent body is formed is one of yttrium, zirconium, or a metal including one of yttrium and zirconium.

4. The discharge lamp according to claim 1, wherein said metal which can absorb hydrogen of which the hydrogen absorbent body is formed is one of yttrium, zirconium, or a metal comprising one of yttrium and zirconium.

5. The discharge lamp according to claim 1, wherein said container has ends that have been pinched together in manner such that tapered end portions have been formed.

6. The discharge lamp according to claim 5, wherein the tapered end portions are welded together.

7. The discharge lamp according to claim 2, wherein said tube-shaped member has been wrapped around and fixed to an electrode rod of at least one of the electrodes.

8. The discharge lamp according to claim 1, wherein said container is formed of a tube member having a hat-shaped cross-section which is closed by a cover member.

9. The discharge lamp according to claim 8, wherein the hat-shaped tube member comprises a flange part which is joined to the cover member by welding.

* * * * *